US010294003B2

(12) United States Patent
Yamamura

(10) Patent No.: US 10,294,003 B2
(45) Date of Patent: May 21, 2019

(54) BUFFERING MEMBER

(71) Applicant: KYOCERA Document Solutions Inc., Osaka (JP)

(72) Inventor: Kazuyoshi Yamamura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 133 days.

(21) Appl. No.: 15/324,070

(22) PCT Filed: Jul. 8, 2015

(86) PCT No.: PCT/JP2015/069663

§ 371 (c)(1),
(2) Date: Jan. 5, 2017

(87) PCT Pub. No.: WO2016/047239

PCT Pub. Date: Mar. 31, 2016

(65) Prior Publication Data

US 2017/0203902 A1 Jul. 20, 2017

(30) Foreign Application Priority Data

Sep. 22, 2014 (JP) ..... 2014-192194

(51) Int. Cl.
*B65D 81/02* (2006.01)
*B65D 5/50* (2006.01)
(Continued)

(52) U.S. Cl.
CPC ..... *B65D 81/02* (2013.01); *B65D 5/50* (2013.01); *B65D 5/5035* (2013.01);
(Continued)

(58) Field of Classification Search
CPC ..... B65D 5/0281; B65D 5/22; B65D 5/321; B65D 5/503; B65D 5/5038; B65D 5/5052;
(Continued)

(56) References Cited

U.S. PATENT DOCUMENTS 2,134,375 A * 10/1938 Price ..... B65D 5/5038 206/320
3,017,018 A * 1/1962 Price ..... B65D 5/5038 206/422
(Continued)

FOREIGN PATENT DOCUMENTS

JP 2005-041564 A 2/2005
JP 2008-030832 A 2/2008

*Primary Examiner* — Anthony D Stashick
*Assistant Examiner* — Mollie Impink
(74) *Attorney, Agent, or Firm* — Studebaker & Brackett PC

(57) ABSTRACT

A buffering member (1) is interposed between a packaging box (4) having a bottom plate (41) and side plates (42*a*), (42*b*) stood along peripheral edges of the bottom plate (41) and a first packed article (5). The buffering member (1) includes a placement section (10) on which the first packed article (5) is to be placed and a pair of leg pieces (31), (35) to be connected to a pair of opposing edges of the placement section (10) via folding lines (32), (36). The pair of leg pieces (31), (32) are folded downward along the folding line (32), (36) with an obtuse angle with respect to the placement section (10) and then lower edges (31*b*), (35*b*) of the pair of leg pieces (31), (35) are engaged with boundaries between the bottom plate (41) and the side plates (42*a*) of the packaging box (4).

10 Claims, 6 Drawing Sheets

(51) Int. Cl.
*G03G 21/18* (2006.01)
*B65D 5/10* (2006.01)
*B65D 5/02* (2006.01)

(52) U.S. Cl.
CPC ..... *B65D 5/5038* (2013.01); *B65D 5/5052* (2013.01); *B65D 5/5059* (2013.01); *G03G 21/181* (2013.01); *B65D 5/0281* (2013.01); *B65D 5/106* (2013.01); *B65D 5/5066* (2013.01); *B65D 2585/689* (2013.01); *B65D 2585/6892* (2013.01)

(58) Field of Classification Search
CPC .. B65D 5/5061; B65D 5/5066; B65D 5/5076; B65D 5/508; B65D 81/05; B65D 81/113; B65D 5/50; B65D 81/02; G03G 21/181
USPC ..... 206/583, 723; 428/121
See application file for complete search history.

(56) References Cited

U.S. PATENT DOCUMENTS 5,676,245 A * 10/1997 Jones ..... B65D 5/5028 206/223
6,308,828 B1 * 10/2001 Jones ..... B65D 73/0078 206/223
7,780,010 B2 * 8/2010 Kinuhata ..... B65D 5/504 206/485
2008/0073418 A1 * 3/2008 Hsu ..... B65D 5/5038 229/120.28
2014/0360913 A1 * 12/2014 McDonald ..... B65D 5/22 206/583

* cited by examiner

BUFFERING MEMBER

TECHNICAL FIELD

The present invention relates to a buffering member interposed between a packaging box and a packaged article.

BACKGROUND

Some image forming apparatuses are provided with replacement parts to store consumables. Such replacement parts include a toner cartridge to contain a toner (a developer). The toner cartridge is packaged in a packaging box via a buffering member in order to prevent the toner from being ejected or the toner cartridge from being damaged when the toner cartridge is applied with an impact or dropped during storage or transportation. The packaging box or the buffering member to package the toner cartridge which is one of the replacement parts is required to be formed of a minimum number of components and then to minimize an increase in cost.

In Patent Document 1 or Patent Document 2, there is proposed a buffering structure in which buffering members each formed by folding a corrugated cardboard into a rectangular cylindrical shape are oppositely disposed inside of the packaging box, and via the buffering members, a packed article is packaged.

PRIOR ART DOCUMENT

Patent Document

[Patent Document 1] Japanese Patent laid-open Publication No. 2005-41564

[Patent Document 2] Japanese Patent laid-open Publication No. 2008-30832

SUMMARY OF INVENTION

Problems to be Solved by the Invention

In the buffering structure described in Patent Document 1 or Patent Document 2, since the buffering members are disposed at two opposing positions in the packaging box, the amount of corrugated cardboard to be used increases or the assembling steps increase, causing an increase in cost. There is a case in which a buffering structure is formed by utilizing an inner flap of the packaging box; however, the structure of the packaging box becomes complicated and an unnecessary portion is produced in the corrugated cardboard as a material. Therefore, the amount of corrugated cardboards to be used increases.

The present invention has been made in view of the circumstance described above, and it is an object of the present invention to provide a buffering member which is simple in assembling or structure and is capable of reliably supporting a packaged article.

Means of Solving the Problems

According to the present invention, a buffering member is interposed between a packaging box having a bottom plate and side plates stood along peripheral edges of the bottom plate and a first packed article. The buffering member includes a placement section and at least one pair of leg pieces. On the placement section, the first packed article is placed. The pair of leg pieces are connected to a pair of opposing edges of the placement section via folding lines. The pair of leg pieces are folded downward along the folding line with an obtuse angle with respect to the placement section and then lower edges of the pair of leg pieces are engaged with boundaries between the bottom plate and the side plates of the packaging box.

Effects of the Invention

According to the present invention, a buffering member is held in a posture to be engaged with a packaging box due to a weight of a first packaged article so that the first packaged article can be stably supported above a bottom plate of the packaging box with a space. Further, a structure of the buffering member is simple so that an amount of the packaging material to be used can be reduced and the buffering member can be therefore assembled with a simple work procedure.

THE MODE FOR CARRYING OUT THE INVENTION

Hereinafter, with reference to figures, a buffering member according to an embodiment of the present disclosure will be described.

Figure 1:
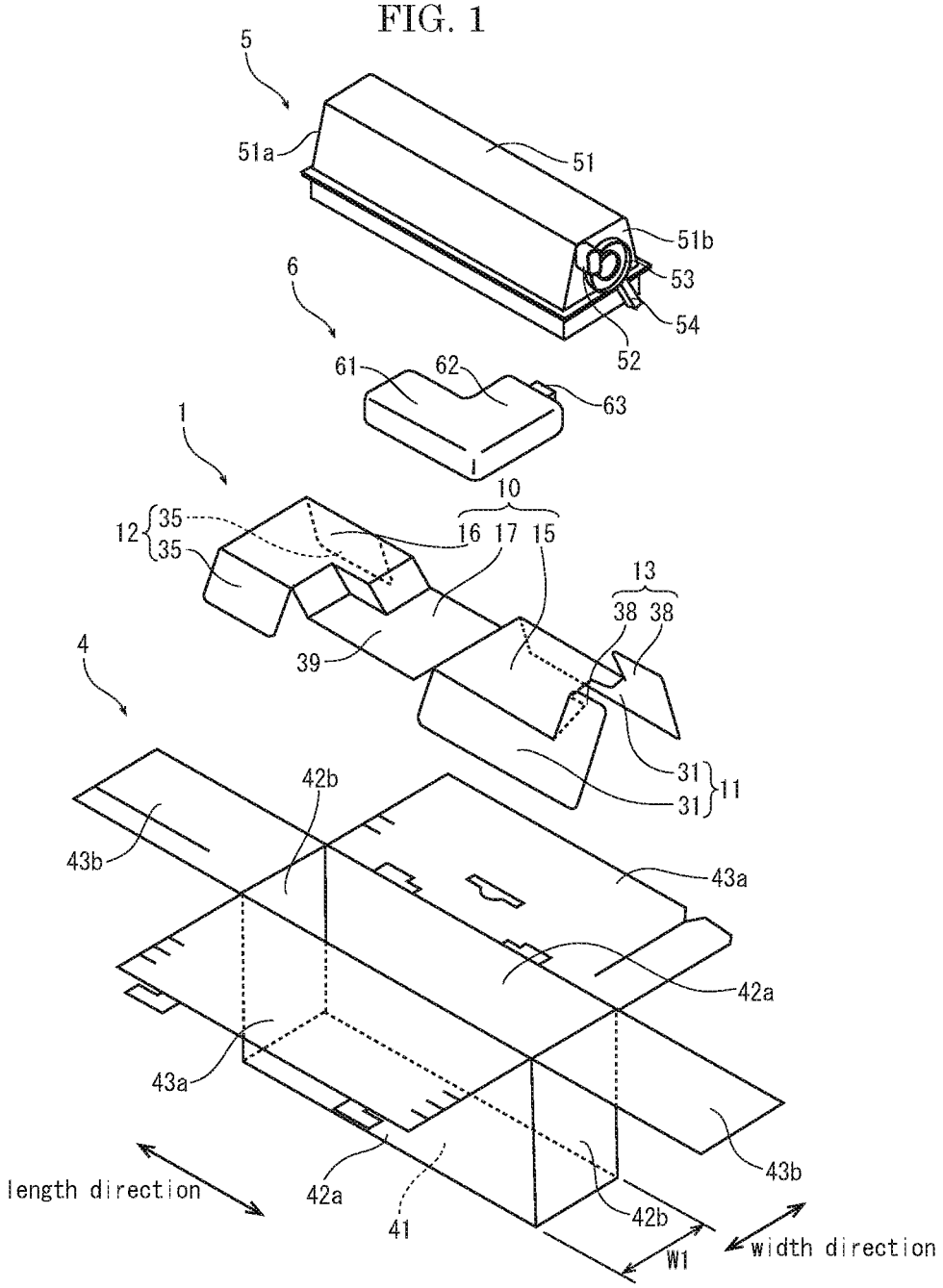
FIG. 1 is an exploded perspective view showing a packaging box including a buffering member according to an embodiment of the present invention.

As shown in FIG. 1, a buffering member 1 according to an embodiment of the present invention is interposed between a packaging box 4 and a toner cartridge 5, as a first packed article, and supports a waste toner collecting bottle 6, as a second packed article. In the following description, a long-side direction and a short-side direction of the buffering member 1 and the packaging box 4 in FIG. 1 are respectively a length direction and a width direction of the buffering member 1 and the packaging box 4.

First, the shapes of the toner cartridge 5 and the collecting bottle 6 will be described. The toner cartridge 5 has a main body 51 formed in a substantially parallelepiped shape. Although one end face 51*a* on one side in the length direction of the main body 51 is formed to be comparatively rigid and to be provided with almost no protrusion or movable part, the other end face 51*b* on the other side is provided with movable pieces and protrusions, such as a fixed piece 52 to be coupled with a development device when attached to an image forming apparatus, a coupling gear 53 and an attachment lever 54 to rotate the coupling gear 53.

The collecting bottle 6 is a thin container and has a bottom part 61 of a large width and an upper part 62 of a smaller width than the width of the bottom part 61. The upper part 62 is formed with a connecting port 63 to which a waste toner discharging port of the image forming apparatus is connected.

Next, the packaging box 4 will be described. The packaging box 4 has a rectangular bottom plate 41, a pair of long side plates 42*a* which are stood along a pair of long side edges of the bottom plate 41 and a pair of short side plates 42*b* which are stood along a pair of short side edges of the bottom plate 41. Outer flaps 43*a* are connected to the pair of long side plates 42*a* via folding lines. Inner flaps 43*b* are connected to the pair of short side plates 42*b* via folding lines. A width of the bottom plate 41 is set to be W1.

Figure 2:
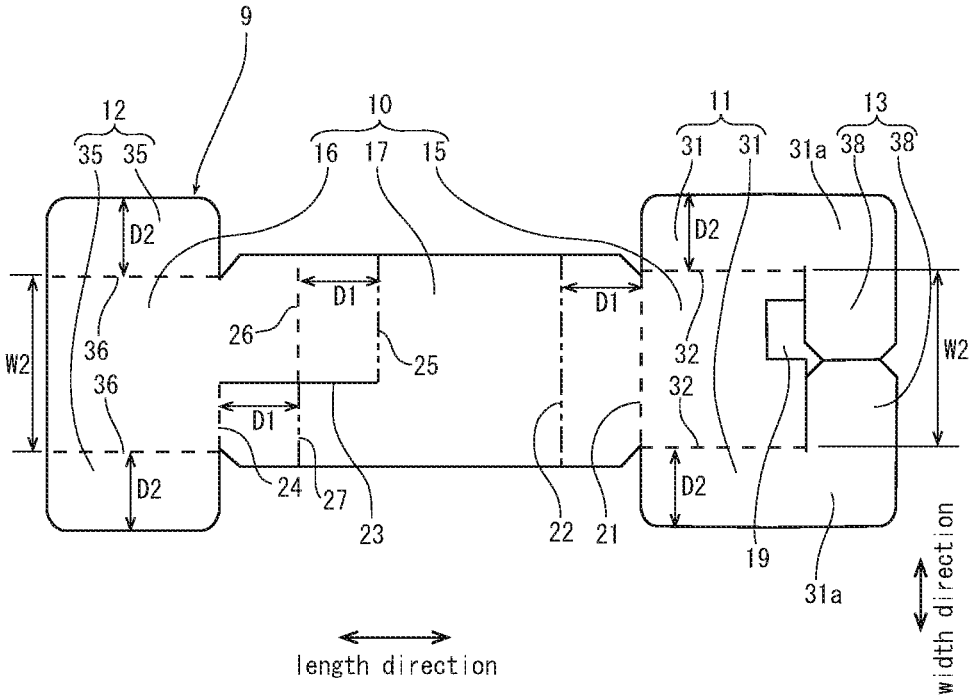
FIG. 2 is a development view showing the buffering member according to the embodiment of the present invention.
Figure 3:
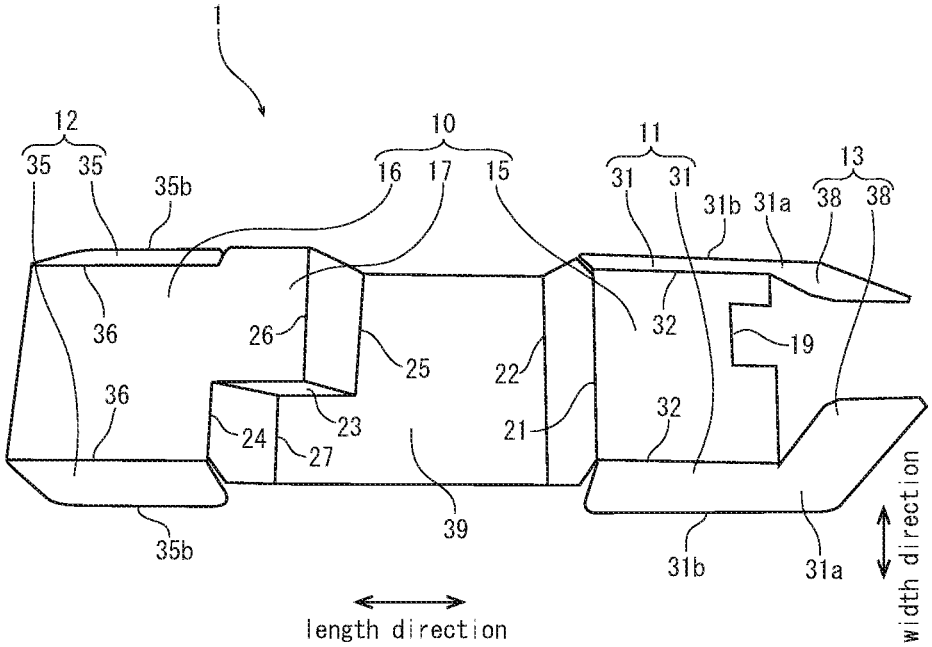
FIG. 3 is a perspective view showing the buffering member viewed from an upper side, according to the embodiment of the present invention.

Next, with reference to FIG. 2 and FIG. 3, the buffering member 1 will be described. FIG. 2 is a development view showing the buffering member and FIG. 3 is a perspective view showing the buffering member. Upper and lower directions and left and right directions in the following description respectively show upper and lower directions and left and right directions in FIG. 2.

The buffering member 1 is assembled by forming a folding line and a slit in a substantially rectangular packaging material 9 (for example, a corrugated cardboard) and then folding the packaging material along the folding line. As shown in FIG. 2, the packaging material 9 has a substantially rectangular placement section 10, a first leg section 11 and a second leg section 12 which are respectively connected to both end portions of both side edges of the placement section 10 via folding lines and a holding section 13 continuously provided to the first leg section 11.

The placement section 10 has a first end part 15 on one end side in the length direction (the right end side of FIG. 2), a second end part 16 on the other end side in the length direction (the left end side of FIG. 2) and a central part 17 between the first end part 15 and the second end part 16. The first end part 15 and the second end part 16 each have a substantially equal length and a width W2 smaller than the width W1 of the bottom plate 41 of the packaging box 4. The central part 17 has a length longer than that of each of the first end part 15 and the second end part 16 and a width equal to the width W1 of the bottom plate 41 of the packaging box 4.

Along an end edge of the first end part 15, a notch 19 is formed. The notch 19 is cut out into a rectangular shape toward the central part 17 (leftward of FIG. 2) from a portion (the upper side portion of FIG. 2) displaced from the center in the width direction of the end edge.

Between the central part 17 and the first end part 15, a mountain folding line 21 is formed along the width direction. The central part 17 is formed with a valley folding line 22 along the width direction close to the mountain folding line 21. An interval between the mountain folding line 21 and the valley folding line 22 is set to be D1.

Further, the central part 17 is formed with a longitudinal slit 23 along the length direction from a boundary between the second end part 16 and the central part 17 up to a portion slightly before the center in the length direction of the central part 17. The longitudinal slit 23 is formed at a position (a slightly lower position of FIG. 2) shifted from the center in the width direction of the central part 17. A mountain folding line 24 is formed along the width direction between an end (the left end of FIG. 2) on the second end part 16 side of the longitudinal slit 23 and one side edge (the lower side edge of FIG. 2) of the central part 17. A valley folding line 25 is formed along the width direction between an opposite end (the right end of FIG. 2) of the longitudinal slit 23 and the other side edge (the upper side edge of FIG. 2) of the central part 17. Further, a valley folding line 27 is formed along the width direction between a center in the length direction of the longitudinal slit 23 and one side edge (the lower side edge) of the central part 17. A mountain folding line 26 is formed along the width direction between the center in the length direction of the longitudinal slit 23 and the other side edge (the upper side edge) of the central part 17. An interval D1 between the mountain folding line 24 and the valley folding line 27 and an interval D1 between the mountain folding line 26 and the valley folding line 25 each are equal to the interval D1 between the mountain folding line 21 and the valley folding line 22. Also, corners of the central part 17 are obliquely chamfered.

The first leg section 11 has a pair of rectangular leg pieces 31 each having a length larger than that of the first end part 15 of the placement section 10. The leg pieces 31 are connected to the side edges of the first end part 15 via mountain folding lines 32 to extend in an outer direction (the rightward direction of FIG. 2) beyond the end edge of the first end part 15 in the length direction. In the following description, an extended portion of each leg piece 31 is called as an extended piece 31*a*. The leg pieces 31 each have a width D2 larger than the interval D1 between the mountain folding line 21 and the valley folding line 22. Corners of each leg piece 31 are chamfered in arc shapes.

The second leg section 12 has a pair of rectangular leg pieces 35 each having a length equal to that of the second end part 16 of the placement section 10. The leg pieces 35 are connected to the side edges of the second end part 16 via mountain folding lines 36. The leg pieces 35 each have a width D2 equal to the width D2 of the leg pieces 31 of the first leg section 11. Corners of each leg piece 35 are chamfered in arc shapes.

The holding section 13 has a pair of holding pieces 38 each having a rectangular shape. The holding pieces 38 are extended inwardly from inside edges of the extended piece 31*a* of the first leg section 11. As shown in FIG. 2, the inside edges of the holding pieces 38 are abutted to each other at the center in the width direction of the first end part 15. Corners of each holding piece 38 are obliquely chamfered.

Figure 4:
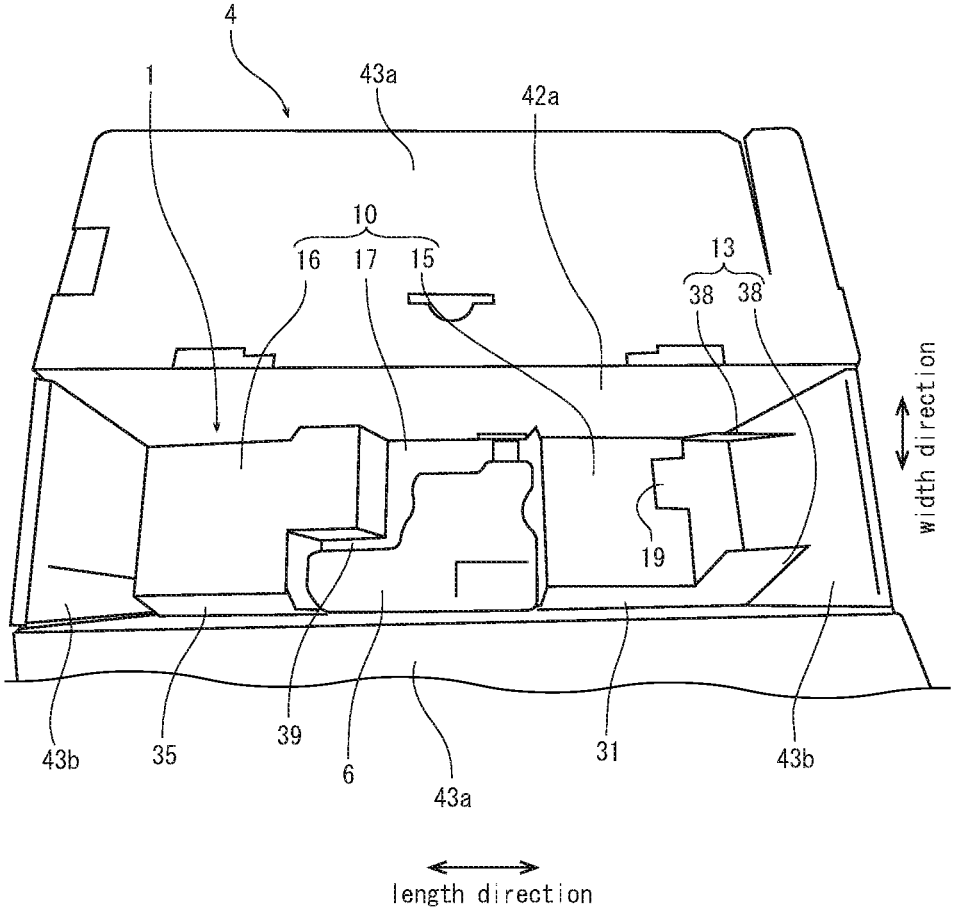
FIG. 4 is a perspective view showing the buffering member installed in the packaging box viewed from the upper side, according to the embodiment of the present invention.
Figure 5:
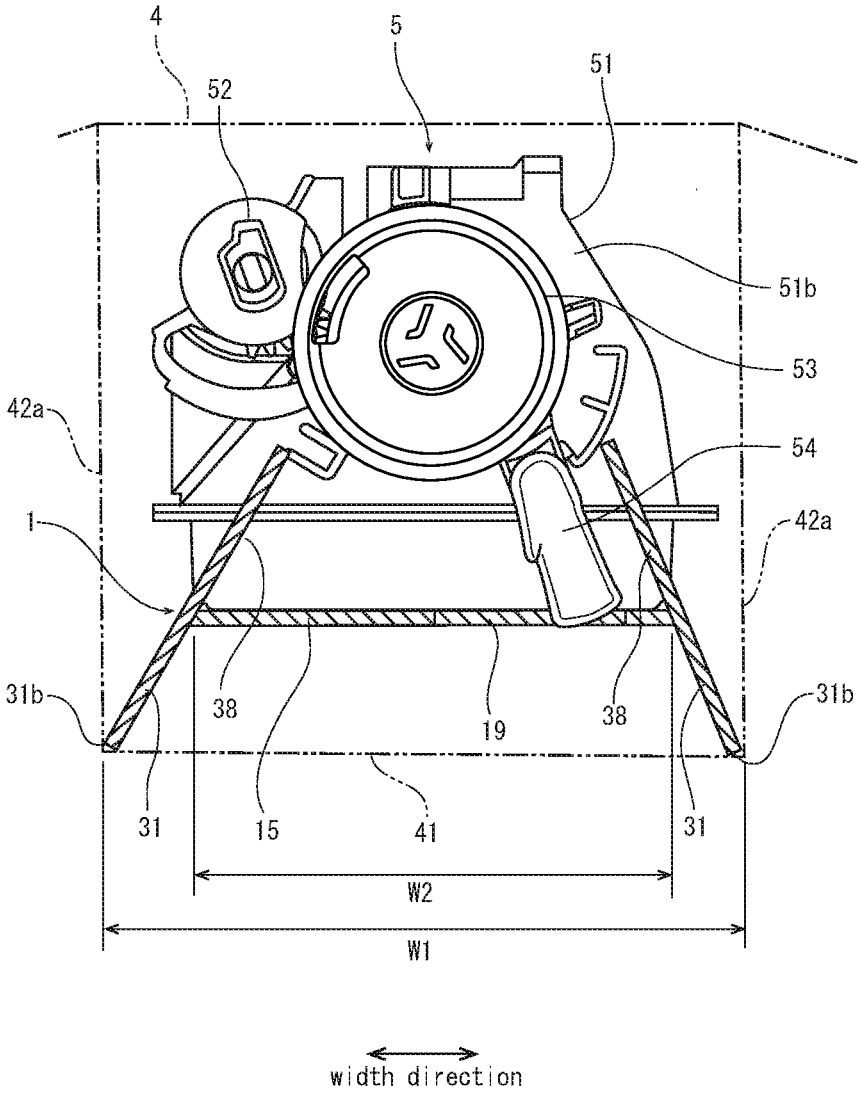
FIG. 5 is a front view showing an end face of a first packaged article placed on the buffering member according to the embodiment of the present invention.
Figure 6A:
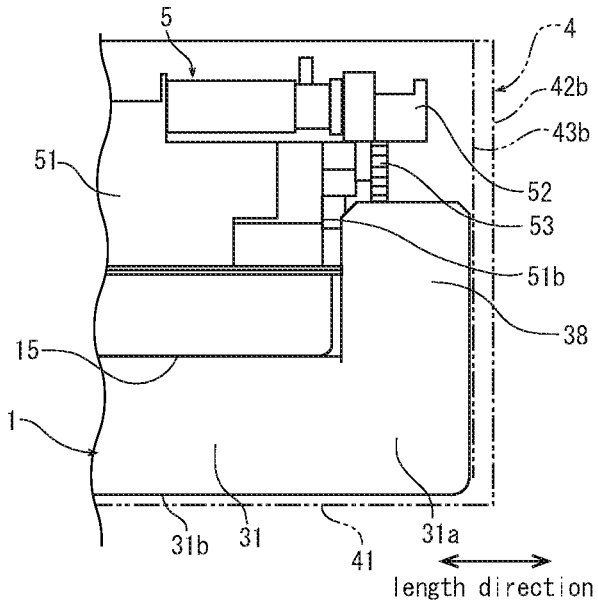
FIG. 6A is a side view showing the end of the first packed article placed on the buffering member viewed from a left side, according to the embodiment of the present invention.
Figure 6B:
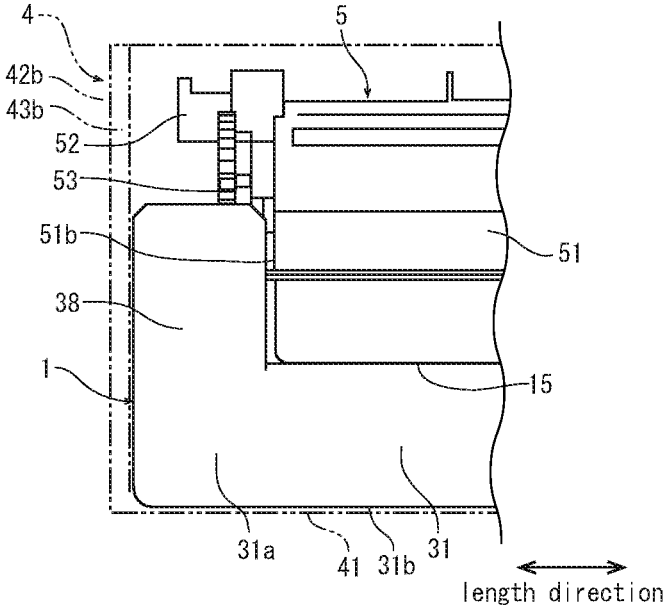
FIG. 6B is a side view showing the end of the first packed article placed on the buffering ember viewed from a right side, according to the embodiment of the present invention.

A method of packaging the toner cartridge 5 and the collecting bottle 6 in the packaging box 4 by employing the buffering member 1 having the above construction will be described with reference to FIG. 1 and FIG. 3 to FIG. 6B. FIG. 3 is a perspective view showing the folded buffering viewed from the upper side, FIG. 4 is a perspective view showing the packaging box during the packaging procedure viewed from the upper side, FIG. 5 and FIG. 6A and FIG. 6B are views each showing an end of the toner cartridge packaged in the packaging box, wherein FIG. 5 is a front view, FIG. 6A is a left side view, and FIG. 6B is a right side view.

First, in the packaging box 4 shown in FIG. 1, the inner flaps 43*b* are folded inward so as to overlap on the corresponding short side plates 42*b*. Then, the packing material 9 shown in FIG. 2 is folded to form the buffering member 1. Initially, the mountain folding lines 21, 24 and 26 formed in the central part 17 of the placement section 10 are mountain-folded and the valley folding lines 22, 25 and 27 are valley-folded. In this manner, as shown in FIG. 3, a recessed part 39 having an L-shape reversed in the left and right directions in a planar view is formed in the central part 17.

Next, the leg pieces 31, 35 are respectively mountain-folded along the mountain folding lines 32, 36. In this manner, in the first leg section 11, the holding pieces 38 of the holding section 13 extended from the extended pieces 31*a* of the leg pieces 31 are cut and raised in the upper direction which is an opposite direction to the folding direction of the leg pieces 31.

Then, thus formed buffering member 1 is installed on the bottom plate 41 of the packaging box 4. Here, since the width W2 of the first end part 15 and the second end part 16 of the placement section 10 to which the first leg section 11 and the second leg section 12 are respectively connected is smaller than the width W1 of the bottom plate 41 of the packaging box 4, the leg pieces 31, 35 of the first and second leg sections 11, 12 each are bent with an obtuse angle with respect to the first end part 15 and the second end part 16. And, the leg pieces 31, 35 are bent into in a reverse-V shape in a side view due to elasticity of the packaging material 9 (the corrugated cardboard). Then, lower end edges 31*b*, 35*b* of the leg pieces 31, 35 are engaged with boundaries between the bottom plate 41 and the long side plates 42*a* of the packaging box 4. At this juncture, the holding pieces 38 of the holding section 13 also incline in the reverse-V shape together with the leg pieces 31. In addition, since the inner flaps 43*b* folded so as to overlap on the short side plates 42*b* is interposed between the end edges in the long-side direction of the buffering member 1 and the short side plates 42*b* of the packaging box 4, the buffering member 1 is prevented from being moved in the long-side direction.

Next, as shown in FIG. 4, after the collecting bottle 6 is placed in the recessed part 39 formed in the central part 17 of the placement section 10, the toner cartridge 5 is placed on the placement section 10. At this juncture, the toner cartridge 5 is placed with the end face 51*b* provided with the coupling gear 53 and the attachment lever 54 on the first end part 15 side.

Then, as shown in FIG. 5, the coupling gear 53 is disposed between the opposing holding pieces 38 of the holding section 13, the attachment lever 54 is engaged with the notch 19 formed in the first end part 15 of the placement section 10, and as shown in FIG. 6A and FIG. 6B, the end face 51*b* of the main body 51 of the toner cartridge 5 is abutted against the holding pieces 38. In this manner, between the end face 51*b* of the main body 51 of the toner cartridge 5 and the inner flap 43*b* of the packaging box 4, a space in which the holding pieces 38 are interposed is formed, and in this space, the fixed piece 52, the coupling gear 53, the attachment lever 54 and the like are stored. Further, as shown in FIG. 5, since the opposing faces (the inside faces) of the holding pieces 38 abut against the protrusion provided on the end face 51*b* of the main body 51, the main body 51 is prevented from being moved in the width direction. Here, the opposing faces of the holding piece 38 includes upper edges of the holding pieces 38.

In addition, by a part of the folded inner flap 43*b*, the toner cartridge 5 is biased toward the holding section 13. In this manner, the holding pieces 38 and the inner flaps 43*b* prevent the toner cartridge 5 from being moved in the length direction.

In addition, when the toner cartridge 5 is placed on the placement section 10, the leg pieces 31, 35 are biased in a direction in which the leg pieces 31, 35 are separated each other due to a downward force applied from the toner cartridge 5 to the placement section 10. As a result, the leg pieces 31, 35 are maintained in the reverse-V posture. Accordingly, the leg pieces 31, 35 may not be folded inward. Lastly, the outer flaps 43*a* are closed and then the packaging box 4 is sealed.

As described hereinabove, according to the buffering member 1 of the present invention, the toner cartridge 5 can be stably supported above the bottom plate 41 of the packaging box 4 with a space by a simple work in which the first leg section 11 and the second leg section 12 are folded. Further, the movement of the toner cartridge 5 can be prevented by the holding section 13. In addition, the fixed piece 52, the coupling gear 53 and the attachment lever 54 provided on the end face 51*b* of the main body 51 of the toner cartridge 5 can be protected by the holding section 13. Accordingly, the toner cartridge 5 can be reliably protected against drop or impact. In addition, the structure of the buffering member 1 is simplified and the amount of the corrugated cardboard to be used can be decreased.

In addition, since the leg pieces 31, 35 are stably maintained in the reverse-V posture due to the downward force applied to the placement section 10 from the toner cartridge 5, the toner cartridge 5 can be reliably supported above the bottom plate 41 of the packaging box 4 with a space. Further, since the width of the central part 17 is equal to the width W1 of the bottom plate 41 of the packaging box 4 and the width W2 of each of the first end part 15 and the second end part 16 is smaller than the width W1 of the bottom plate 41, the buffering member 1 is easily inserted into the packaging box 4 and can be stably disposed in the packaging box 4.

Further, in a case where the collecting bottle 6 that is the second packed article exists, the collecting bottle 6 can be supported in the recessed part 39 immovably without exerting an influence on support of the toner cartridge 5. In addition, the recessed part 39 is formed in a space between the placement section 10 and the bottom plate 41 of the packaging box 4, namely, in a space for buffering of the toner cartridge 5, so that the space in the packaging box 4 can be efficiently utilized. Further, since the collecting bottle 6 can be supported by the buffering member 1 together with the toner cartridge 5, the parts exclusively used to support the collecting bottle 6 is not required, and the amount of the corrugated cardboard to be used can be further decreased.

Furthermore, since the first leg section 11 and the second leg section 12 are respectively connected to the first end part 15 and the second end part 16 of the placement section 10 and are not provided at the central part 17, the amount of the corrugated cardboard to be used can be further decreased. Incidentally, although both ends of the toner cartridge 5 in the length direction are supported at the first end part 15, the second end part 16 of the placement section 10 and a part of the central part 17 continuous to the second end part 16, the toner cartridge 5 can be supported by the buffering member 1 with no problem in strength because of its rigidity in the length direction.

In addition, in the packaging box 4 with different dimensions also, the buffering member 1 can be used in common for the packaging box 4 with different dimensions if an inclination angle of each of the leg pieces 31, 35 is varied so as to be engaged with the boundaries between the bottom plate 41 and the side plates 42 of the packaging box 4.

Incidentally, although in the embodiment, the recessed part 39 to store the collecting bottle 6 is formed in the central part 17 of the placement section 10 of the buffering member 1, in a case where the collecting bottle 6 does not exist, there is no need to form the recessed part 39.

Also, in the case where there is no need to form the recessed part 39, etc., one leg section formed by a pair of leg pieces may be provided on the placement section 10. In this case also, along an end portion of each leg piece, a pair of holding parts cut and raised in the opposite direction to the folding direction can be formed.

In addition, although the embodiment is described as to the case in which a packed article is the toner cartridge 5 that is a replacement member to be attached to the image forming apparatus, the embodiment can be also applied to another replacement member such as a development unit or a drum unit. In the image forming apparatus, since there are many cases in which a movable part or a protrusion to be coupled with another unit or a driving mechanism are provided on one end like the toner cartridge 5, it is preferable to protect such movable part or protrusion by the holding section 13. Further, in a case where a movable part or protrusion is provided at both end of a packaged article, a pair of holding sections 13 can be formed at both of the first leg section 11 and the second leg section 12. Furthermore, although the embodiment is described as to the case of the collecting bottle 6 as the second packaged article, an operation manual or the like can be stored in the recessed part 39.

While the preferable embodiment and its modified example of the buffering member of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

The invention claimed is:

1. A buffering member interposed between a packaging box having a bottom plate and side plates stood along peripheral edges of the bottom plate and a first packed article, the buffering member comprising:

a placement section on which the first packed article is to be placed; and at least one pair of leg pieces to be connected to a pair of opposing edges of the placement section via folding lines, wherein the at least one pair of leg pieces is folded downward along the folding lines with an obtuse angle with respect to the placement section and then lower edges of the at least one pair of leg pieces are engaged with boundaries between the bottom plate and the side plates of the packaging box, wherein the at least one pair of leg pieces includes a pair of holding pieces which are raised in a direction opposite to a folding direction of the at least one pair of leg pieces when the at least one pair of leg pieces is folded downward along the folding lines, and the pair of holding pieces is provided such that the first packed article abuts against opposing faces of the pair of the holding pieces.

2. The buffering member according to claim 1, wherein the placement section has a substantially rectangular shape, the placement section includes:

a first end part provided at one end side in a long-side direction;

a second end part provided at another end side in the long-side direction; and a central part provided between the first end part and the second end part and wherein the first packed article is placed on the first end part and the second end part.

3. The buffering member according to claim 2, wherein the central part of the placement section is formed with a recessed part configured to store a second packed article by being folded downward.

4. The buffering member according to claim 2, wherein the at least one pair of leg pieces is connected to each of the first end part and the second end part.

5. The buffering member according to claim 2, wherein the central part has a width equal to a width of the bottom plate of the packaging box in a direction perpendicular to the long-side direction and the first end part and the second end part each have a width smaller than the width of the central part.

6. The buffering member according to claim 1, wherein the first packed article is a toner cartridge to be attached to an image forming apparatus and the buffering member includes a pair of holding pieces which are raised in a direction opposite to a folding direction of the at least one pair of leg pieces when the at least one pair of leg pieces is folded downward along the folding lines, a space interposed by the pair of holding pieces is formed between an end face in the long-side direction of the toner cartridge and the side plate of the packaging box opposing to the end face in the long-side direction of the toner cartridge and a movable part and a protrusion provided on the end face in the long-side direction of the toner cartridge is stored in the space.

7. The buffering member according to claim 1, wherein the placement section has a rectangular shape and the at least one pair of leg pieces is connected to a pair of opposing long edges of the placement section via the folding lines.

8. The buffering member according to claim 1, wherein the packaging box has flaps which are connected via folding lines along upper edges of opposing side plates opposing in a long-side direction of the placement section, the flaps being folded inward along the folding lines so as to overlap on the corresponding side plates.

9. A buffering member interposed between a packaging box having a bottom plate and side plates stood along peripheral edges of the bottom plate and a first packed article, the buffering member comprising:

a placement section on which the first packed article is to be placed; and at least one pair of leg pieces to be connected to a pair of opposing edges of the placement section via folding lines, wherein the first packed article is a toner cartridge to be attached to an image forming apparatus, and the buffering member includes a pair of holding pieces which are raised in a direction opposite to a folding direction of the at least one pair of leg pieces when the at least one pair of leg pieces is folded downward along the folding lines, a space interposed by the pair of holding pieces is formed between an end face in the long-side direction of the toner cartridge and the side plate of the packaging box opposing to the end face in the long-side direction of the toner cartridge and a movable part and a protrusion provided on the end face in the long-side direction of the toner cartridge is stored in the space.

10. A buffering member interposed between a packaging box having a bottom plate and side plates stood along peripheral edges of the bottom plate and a first packed article, the buffering member comprising:

a placement section on which the first packed article is to be placed; and at least one pair of leg pieces to be connected to a pair of opposing edges of the placement section via folding lines, wherein the at least one pair of leg pieces is folded downward along the folding lines with an obtuse angle with respect to the placement section and then lower edges of the at least one pair of leg pieces are engaged with boundaries between the bottom plate and the side plates of the packaging box, wherein the placement section has a substantially rectangular shape, the placement section includes:

a first end part provided at one end side in a long-side direction;

a second end part provided at another end side in the long-side direction; and a central part provided between the first end part and the second end part, and wherein the first packed article is placed on the first end part and the second end part, the central part of the placement section is formed with a recessed part configured to store a second packed article by being folded downward, and the first end part, the second end part and a bottom face of the recess are flat parallel to the bottom plate.

* * * * *